US010342282B2

(12) United States Patent
Salvetti et al.

(10) Patent No.: US 10,342,282 B2
(45) Date of Patent: Jul. 9, 2019

(54) HELMET WITH REMOVABLE PADDING ELEMENT

(71) Applicant: NOLANGROUP S.p.A., Brembate di Sopra (BG) (IT)

(72) Inventors: Alberto Salvetti, Brembate di Sopra (IT); Alberto Mandelli, Brembate di Sopra (IT); Giuseppe D'Adda, Brembate di Sopra (IT)

(73) Assignee: NOLANGROUP S.P.A., Brembate di Sopra (BG) (IT)

( * ) Notice: Subject to any disclaimer, the term of this patent is extended or adjusted under 35 U.S.C. 154(b) by 118 days.

(21) Appl. No.: 15/666,837

(22) Filed: Aug. 2, 2017

(65) Prior Publication Data

US 2018/0035742 A1 Feb. 8, 2018

(30) Foreign Application Priority Data

Aug. 5, 2016 (IT) ..... 102016000083163

(51) Int. Cl.
*A42B 3/04* (2006.01)
*A42B 3/32* (2006.01)
(Continued)

(52) U.S. Cl.
CPC ..... *A42B 3/328* (2013.01); *A42B 3/127* (2013.01)

(58) Field of Classification Search
CPC ..... A42B 3/127; A42B 3/328; A42B 3/12; A42B 3/125; A42B 3/222; A42B 3/04;
(Continued)

(56) References Cited

U.S. PATENT DOCUMENTS 3,761,959 A * 10/1973 Dunning ..... A42B 3/122 137/223
4,831,668 A * 5/1989 Schulz ..... A42B 3/127 2/414

(Continued)

FOREIGN PATENT DOCUMENTS

EP 2022358 A2 2/2009

OTHER PUBLICATIONS

Italian Search Report for Italian Application No. IT201600083163 (dated May 19, 2017) (7 Pages).

*Primary Examiner* — Robert H Muromoto, Jr.
(74) *Attorney, Agent, or Firm* — Lucas & Mercanti, LLP

(57) ABSTRACT

A helmet is disclosed having a padding element removably constrained to the shell and provided with a first seat so that a first protrusion integral with the shell is reversibly engaged, reversible male-female coupling members to reversibly couple the shell and the padding element, which are adapted to define a hinge point for the relative rotation between the shell and the padding element. The helmet has restraining members to selectively restrain and release the first protrusion in and from the first seat. The restraining members are movable between a first restraint position to restrain the first protrusion in the first seat, so that the relative rotation between the shell and the padding element is prevented. A second disengagement position of the first protrusion from the first seat is also provided so that the relative rotation between the shell and the padding element is allowed.

13 Claims, 14 Drawing Sheets

(51) Int. Cl.
*A42B 3/12* (2006.01)
*A42B 3/00* (2006.01)

(58) Field of Classification Search
CPC ..... A42B 3/10; A42B 3/142; A42B 3/223; A42B 3/322; A42B 3/14; A42B 3/145; A42C 2/007; A62B 18/04; F16B 21/08; A63B 71/10
See application file for complete search history.

(56) References Cited

U.S. PATENT DOCUMENTS 5,371,905 A * 12/1994 Keim ..... A42B 3/0473 2/413
5,581,816 A * 12/1996 Davis ..... A42B 3/0473 2/410
5,664,444 A * 9/1997 Schaan ..... A42B 3/0413 70/14
5,857,599 A * 1/1999 Palmer ..... F21L 15/14 2/422
6,279,172 B1 * 8/2001 Epperson ..... A42B 3/12 2/410
6,401,259 B1 * 6/2002 Epperson ..... A42B 3/12 128/201.23
6,421,841 B2 * 7/2002 Ikeda ..... A42B 3/127 2/267
6,851,129 B2 * 2/2005 Gafforio ..... A42B 3/222 2/424
8,239,970 B2 * 8/2012 Ikeda ..... A42B 3/127 2/267
8,800,065 B2 * 8/2014 Ikeda ..... A42B 3/328 2/411
9,681,697 B2 * 6/2017 Ikeda ..... A42B 3/127
2001/0034895 A1 * 11/2001 Ikeda ..... A42B 3/127 2/414
2002/0073479 A1 * 6/2002 Epperson ..... A42B 3/12 2/410
2003/0229934 A1 * 12/2003 Gafforio ..... A42B 3/222 2/424
2004/0049830 A1 * 3/2004 Gafforio ..... A42B 3/222 2/171
2004/0204904 A1 * 10/2004 Ebisawa ..... A42C 2/007 702/170
2007/0209098 A1 * 9/2007 Peart ..... A42B 3/124 2/410
2007/0271688 A1 * 11/2007 Ando ..... A42B 3/127 2/410
2009/0038054 A1 * 2/2009 Ikeda ..... A42B 3/328 2/414
2012/0073034 A1 * 3/2012 Gafforio ..... A42B 3/127 2/414
2013/0174330 A1 * 7/2013 Gafforio ..... A42B 3/283 2/412
2016/0316846 A1 * 11/2016 Salvetti ..... A42B 3/125
2017/0215508 A1 * 8/2017 Salvetti ..... A42B 3/125

* cited by examiner

HELMET WITH REMOVABLE PADDING ELEMENT

CROSS-REFERENCE TO RELATED APPLICATIONS

This application claims the benefit of Italian Patent Application No. 102016000083163 also identified as Application No. UA2016A005952, filed Aug. 5, 2016, the contents of which are incorporated herein by reference.

FIELD OF INVENTION

The present invention refers to the helmet field, in particular integral helmets for bikers or the like, which are provided with padding elements, typically cheek pads, removably constrained to the shell.

BACKGROUND OF INVENTION

Such helmets generally comprise an outer shell, for example made of ABS, polycarbonate, etc. or composite material, such as carbon and/or aramid and/or glass fibers, and an inner shell generally foam-made, such as polystyrene. The assembly of such outer and inner shells, the first one fixed to cover the latter, aids to form what hereinafter we generically denote as "shell" and substantially constitute the helmet portion adapted to accommodate the rider's head of a motorcycle or the like. In order to improve the rider's safety and better adapt the inner portion of the shell to the rider's head, usually padding elements are arranged inside the shell.

Typically, such padding elements comprise little cushions or pads, for example made of foam rubber, arranged at the cheeks and chin of the rider wearing the helmet itself. Such devices are usually deformable and, in use, they have a portion engaging the lower portion of the chin.

Such solution increases the user's comfort and safety, but wearing the helmet and removing the head from the helmet become complex. This is a problem, for example, especially when the helmet user has a road accident, and someone aiding the injured rider has to remove the helmet itself. In fact, to carry out such an operation, the rider must apply a high force onto the helmet and then onto the user, thus the health of the injured rider could be compromised. For this reason, removing the helmet from the wearer is very difficult for everyone.

Therefore, helmets having padding elements reversibly constrained to the shell are known, for example by snap-fit buttons.

By removing the padding elements, in particular those placed at the user's chin, the helmet removal from the wearer's head is much simpler. However, the removal operations of the padding element are not simple when the user's head is in the helmet. Moreover, during wearing of the helmet, a certain force is applied against the padding element, so that it is deformed to allow the head to pass. Such force can cause the undesirable detachment of the padding element from the shell, annoying the user.

OBJECTS AND SUMMARY OF THE INVENTION

It is therefore object of the present invention to solve the problems mentioned above.

It is a particular object of the present invention to realize a helmet provided with a padding element being simple to remove if necessary and, at the same time, remaining firmly constrained to the helmet when its detachment is undesirable.

These and other objects are solved by the present invention by means of a helmet according to claim 1. Preferred aspects are set forth in dependent claims.

According to an aspect of the present invention, a helmet comprise: a shell for absorbing shocks; a padding element removably constrained to the shell and provided with at least a first seat so that a relative first protrusion integral with the shell is reversibly engaged; reversible male-female coupling means to reversibly couple the shell and the padding element, which are adapted to define a hinge point for the relative rotation between the shell and the padding element; restraining means to selectively restrain and release the first protrusion in and from the first seat. The shell comprises the male element and the padding element comprises the female element of the reversible coupling means, or vice versa. The restraining means are movable at least between: a first restraint position, wherein said restraining means engage the first seat to restrain said first protrusion in the first seat, so that the relative rotation between the shell and the padding element around the hinge point is prevented; a second disengagement position, wherein the restraining means are disengaged from the first seat to release the first protrusion from the first seat, so that the relative rotation between the shell and the padding element around the hinge point is allowed.

Thanks to the herein proposed solution, the padding element is firmly and integrally constrained with the shell when the restraining means are in the first restraint position, thus avoiding the undesirable and accidental relative movement between the padding element and the shell. On the contrary, when the helmet has to be removed easily from the user's head, the activation of the restraining means allows the first protrusion to be easily released from the first seat and allows a relative rotation between the padding element and the shell.

In particular, the presence of the restraining means allows the accidental release of the padding element from the shell to be effectively avoided and, at the same time, once the restraining means have been activated, the simple removal of the helmet from the user's head is allowed, particularly allowing the relative rotation between the padding element and the shell, so that the padding element is moved to a position substantially not interfering (or minimally interfering) with the user's head.

In particular, it has to be noted that the relative movement between the shell and the padding element is substantially a mere rotation, whereby axial movements (i.e. along a relative moving-away direction) between the padding element and the shell are not needed.

According to an aspect of the invention, the first seat comprises an edge having an open perimeter, which is preferably U-shaped, and the restraining means are designed so that the perimeter of above mentioned edge is closed, in the first restraint position.

Preferably, the reversible male-female coupling means are snap-fit coupling means.

According to an aspect of the invention, the restraining means comprise a lever hinged to the padding element. The lever has an actuation portion, that can be operated by a user to move the restraining means between the first restraint position and the second disengagement position, and an engaging portion adapted to be engaged with the first seat in the first restraint position.

According to an aspect of the invention, elastic elements are arranged to push the restraining means towards the first restraint position.

According to an aspect of the invention, the shell comprises a foam-made portion, and the first protrusion and the male or female element of the reversibly-coupling means, which is integral with the shell, have a threaded portion for coupling to the above mentioned foam-made portion.

According to an aspect of the invention, the threaded portion has one or more of the following features:

- thread having variable depth, preferably a progressively decreasing one;
- ratio, between maximum depth and pitch of the thread of the threaded portion, comprised between 1.00 and 1.80, preferably between 1.20 and 1.60, more preferably equal to about 1.40;
- ratio, between inner diameter Di and the maximum depth Hmax of the thread of said threaded portion, comprised between 0.15 and 0.5, preferably between 0.15 and 0.35, more preferably equal to about 0.23;
- thread with variable thread angle, with minimum value comprised between 25 and 35 degrees, preferably equal to about 30 degrees, and maximum value comprised between 35 and 50 degrees, preferably equal to about 43 degrees.

According to an aspect, the helmet comprises limit means for the restraining means.

According to an aspect of the invention, the limit means comprise a slot and a pin, the latter being adapted to be slidingly engaged in the slot. The pin is integral with the restraining means and the slot is integral with the padding element, or vice versa.

According to an aspect of the invention, the restraining element comprises a second seat to reversibly engage a respective second protrusion integral with the shell.

According to an aspect of the invention the padding element is a side cheek pad.

The present invention further concerns to a method for removing a helmet, according to one or more of the preceding aspects, from the user's head, comprising the steps of:

(a) moving the restraining means from the first restraint position to the second disengagement position, so that the first protrusion can be released from the first seat;
(b) rotating the padding element with respect to the shell around the hinge point;
(c) taking off the helmet from the user's head.

According to an aspect of the invention, the steps (a) and (b) are carried out by applying a force onto the restraining means.

BRIEF DESCRIPTION OF THE DRAWINGS

Referring to the attached figures, an exemplary and not limitative embodiment of the present invention is now introduced, in which.

DETAILED DESCRIPTION OF THE INVENTION

As known, a helmet 1 comprises a shell 2 to accommodate the head of a user. The shell 2 typically has a hollow shape adapted to accommodate the head of a user, can have a number of layers and, in particular, an outer rigid layer, for example made of polycarbonate or composite material, and an inner deformable layer, for example made of expanded polystyrene (EPS), and constitutes the "hull" of the helmet 1.

Inside the shell 2, the helmet has a plurality of padding elements 3 adapted to keep the user's head in a fixed position inside the helmet 1 and which are typically made of foam rubber, and with the shell, it concurs to damp possible impacts, for example in the event of an accident.

As mentioned, it is preferable that some padding element 3 are removable from the shell 2, not only to allow their possible cleaning or replacement, but also to facilitate the removal operations of the user's head from the helmet 1. In the following description reference will be made to a removable side cheek pad, which is the preferred embodiment of the present invention (even if not the only possible one).

It has to be noted that here and in the following, with the term "side cheek pad" is meant the padding portion inside the helmet being shaped and arranged to be in contact with the cheek of a user of a safety helmet, when the latter is worn.

Figure 5:
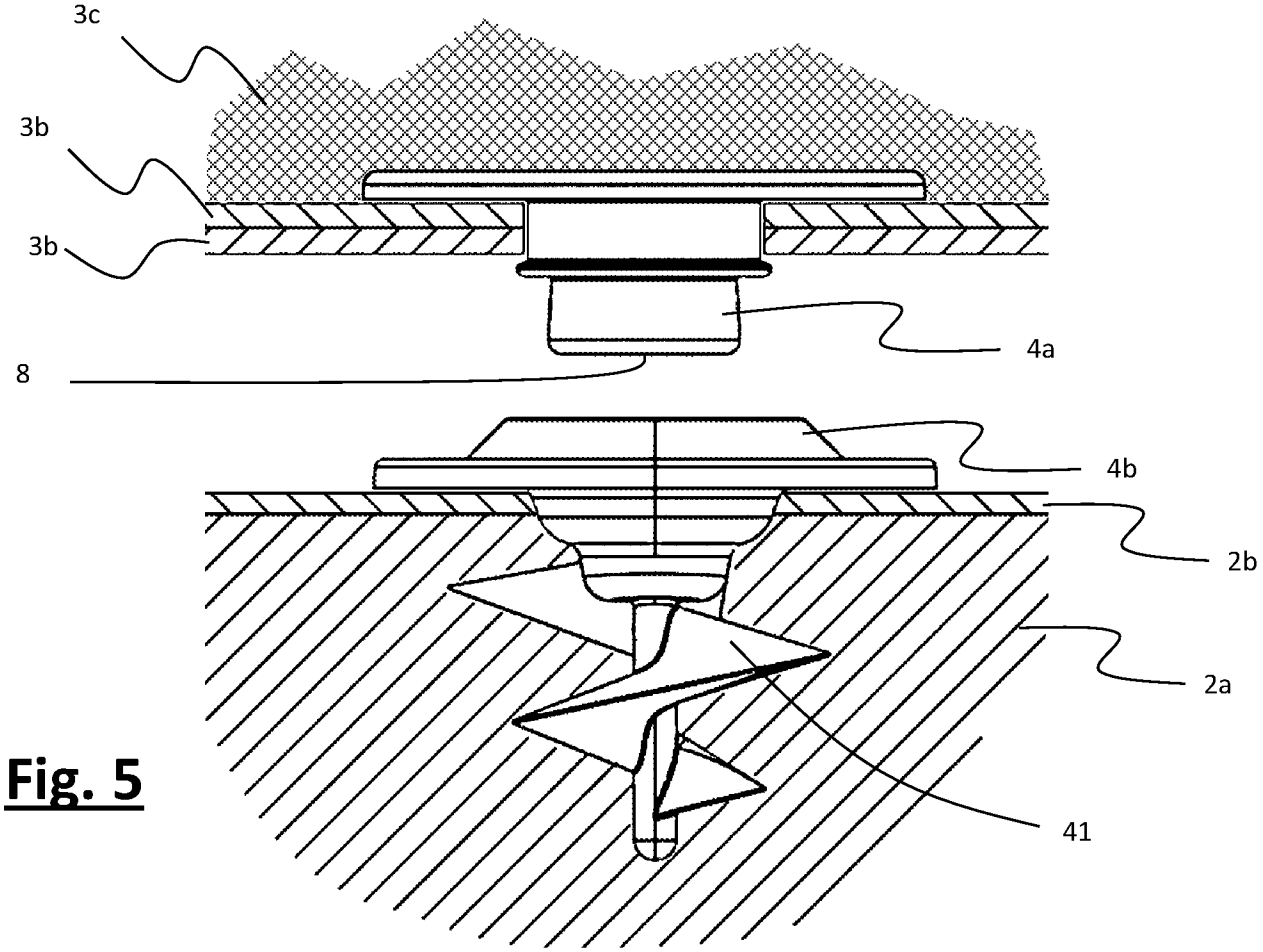
FIG. 5 is a magnified and schematic view of the reversible coupling means.

The padding element 3 is made in a way known in the art, and typically has a frame 3*a*, 3*b* and a soft cover 3*c* schematically shown in FIG. 5 and generally made of foam rubber. In particular, in the embodiment shown, the frame is formed by two elements 3*a*, 3*b* typically made of plastics, which can be constrained to one another in a known way. Alternatively, the frame can be made in one piece. Generally, the frame 3*a*, 3*b* gives the mechanical characteristics to the padding element 3, i.e. it constitutes the supporting structure on which textile parts restraining the soft cover can also be sewn on, whereas the soft cover 3*c* (for example made of foam rubber) gives the damping feature against impacts and provides for the user's comfort.

Figure 1:
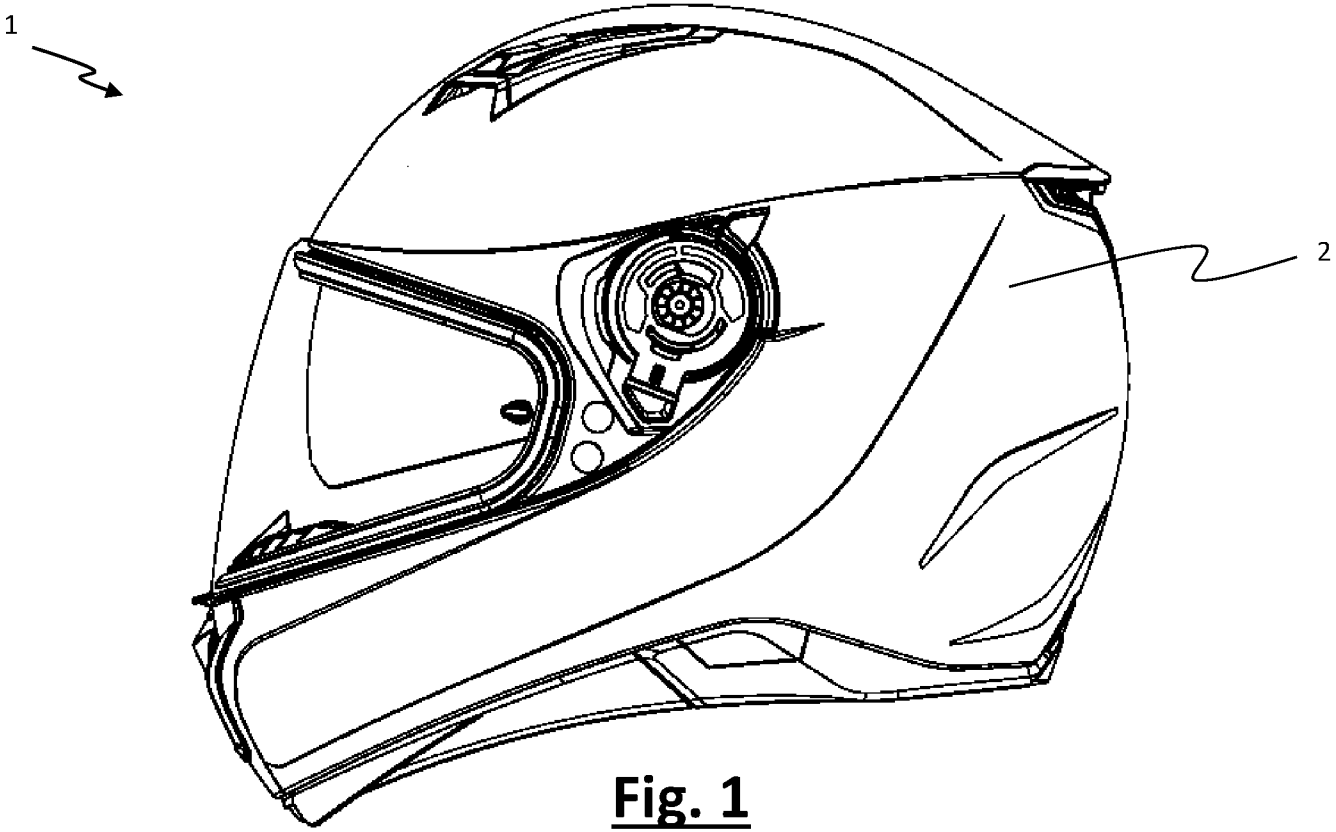
FIG. 1 is a schematic view of a helmet according to a possible embodiment of the present invention.
Figure 2:
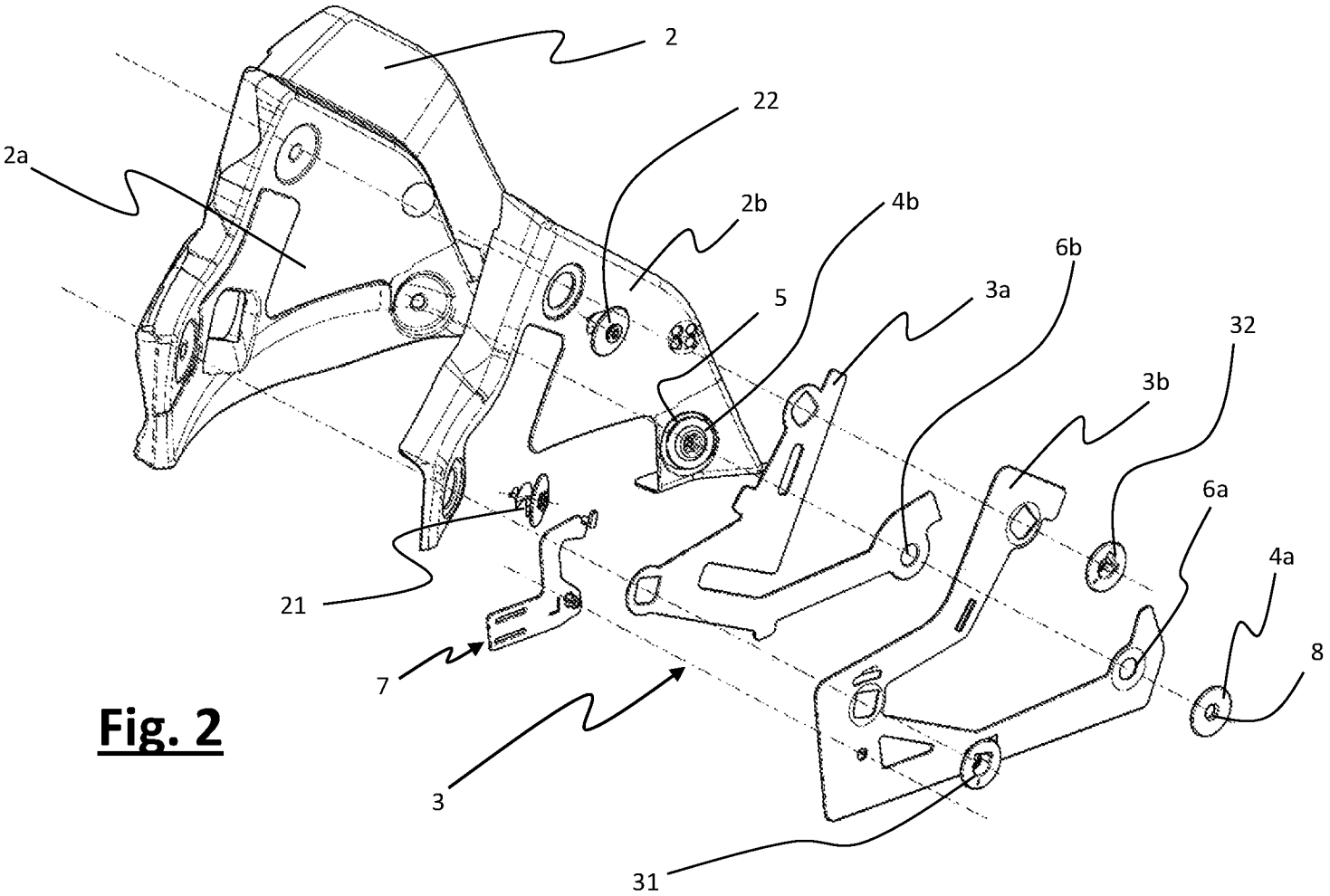
FIG. 2 is an exploded view of a padding element, wherein the covering soft portion has been omitted, and of a helmet shell portion to which the padding is constrained according to a possible embodiment of the present invention.

The helmet 1 further comprises reversible coupling means 4*a*, 4*b* between the padding element 3 and the shell 2. Typically such reversible coupling means 4*a*, 4*b* are of the male-female type, and they can preferably be provided with a snap-fit coupling, i.e. an elastic interlocking coupling between substantially complementary shapes. In the embodiment shown, particularly referring to FIGS. 1 and 5, the reversible coupling means 4*a*, 4*b* comprise a male element 4*a* constrainable to the padding element 3, and a female element 4*b* constrainable to the shell 2. However it is possible the opposite solution, i.e. the male element constrained to the shell and the female element constrained to the padding element 3.

Figure 6:
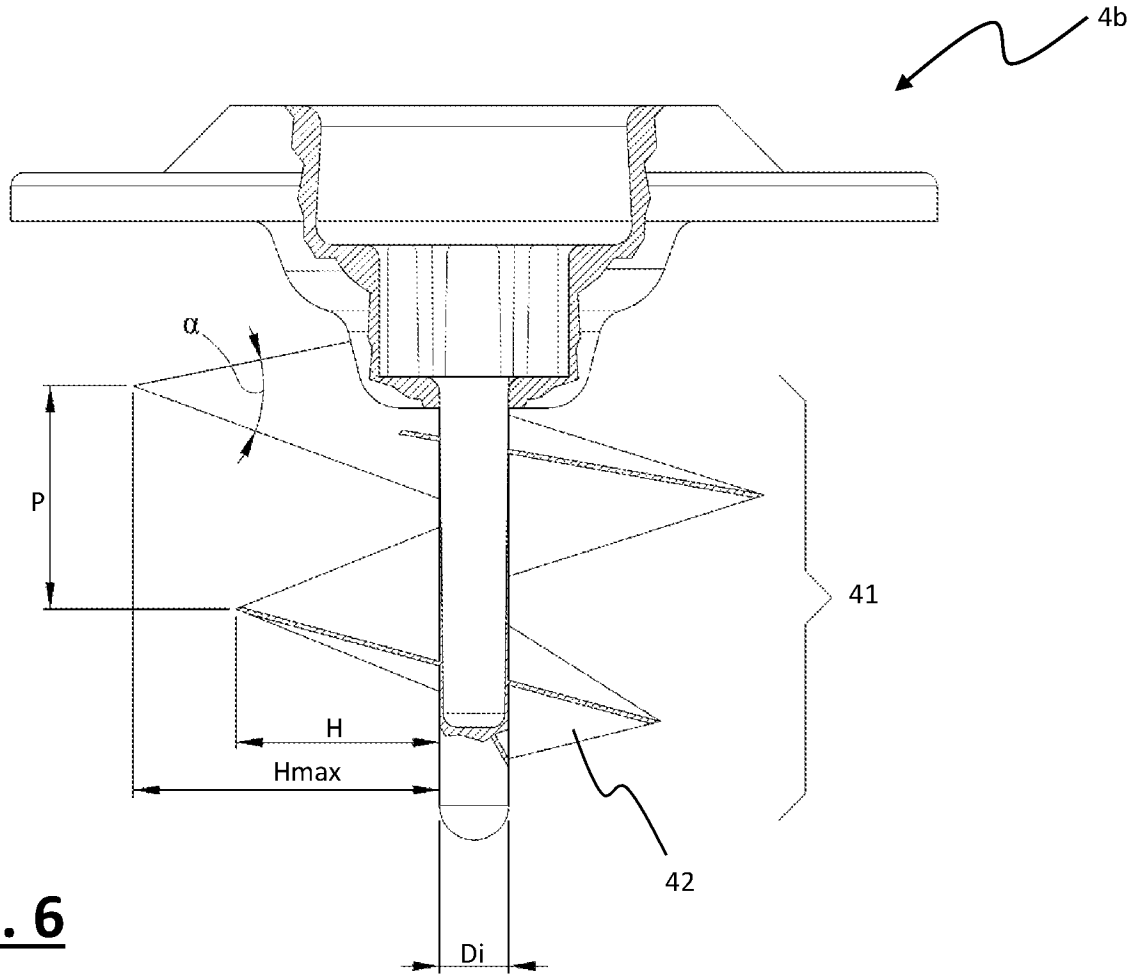
FIG. 6 is a schematic view of the threaded element, in this case the female element, of the reversible coupling means.

Preferably, the shell 2 has at least one inner portion 2*a* made of foamed material, typically expanded polystyrene (EPS). The element of the reversible coupling means 4*a*, 4*b*, that is constrainable to the shell 2, preferably has a threaded portion 41. According to an aspect of the present invention, it is preferred that the thread 42 of the threaded portion 41*a* has higher thread and higher pitch compared to standard screws. Particularly referring to FIG. 6, the preferred parameters for the thread 42 are listed below.

Preferably the thread 42 has variable depth H. Referring to the figures, the thread 42 has gradually decreasing depth H, with minimum value at the leading thread portion.

According to an aspect of the present invention, the ratio between maximum depth Hmax and pitch P of the thread 42 is comprised between 1.00 and 1.80, preferably between 1.20 and 1.60. A preferred value is equal to about 1.40. In particular, in the embodiment shown such a value is equal to 1,374.

The ratio between inner diameter Di and maximum depth Hmax of the thread 42 is preferably comprised between 0.15 and 0.5. More preferably, such a ratio is comprised between 0.15 and 0.35. A preferred value is equal to about 0.23. In the embodiment shown, such a value is equal to 0.228.

In general, as mentioned, the inner diameter Di is made as thin as possible so as to cause the deformation of the threaded portion 41 in case of helmet shock, while ensuring however to the thread a minimum structural resistance so that to allow the screwing thereof in the inner portion 2*a* of the shell 2.

Preferably the thread angle $\alpha$ is in turn variable. The minimum value of a is comprised between 25 and 35 degrees (preferably is equal to about 30 degrees), whereas the maximum value of a is comprised between 35 and 50 degrees (preferably is equal to 43 degrees).

In the shown example, Hmax is equal to 6.575 mm, P is equal to 4.79 mm, Di is equal to 1.50 mm.

In the embodiment shown, the inner portion 2*a* of the shell 2 has a removable plastic cover 2*b*. Such plastic cover 2*b* preferably comprises a housing 5 for the afore said element of the reversible coupling means 4*a*, 4*b*, which is integral with the shell 2, i.e. the female element 4*b* in the embodiment shown in the figures.

Analogously, also the frame 3*a*, 3*b* of the padding element 3 has a housing 6*a*, 6*b* for the other element of the reversible coupling means 4*a*, 4*b*, which is integral with the padding element 3, i.e. the male element 4*a* in the embodiment shown in the figures.

As better explained below, the reversible coupling means 4*a*, 4*b* form a hinge point 8 for the relative rotation between the shell 2 and the padding element 3.

The shell 2 further has a first protrusion 21 adapted to be engaged with a respective first seat 31 of the padding element 3. The first protrusion 21 is preferably constrained to the portion 2*a* of the shell 2 by a threaded portion 21*a*, whose features are similar to the threaded portion 42.

Figures 3, 3A:
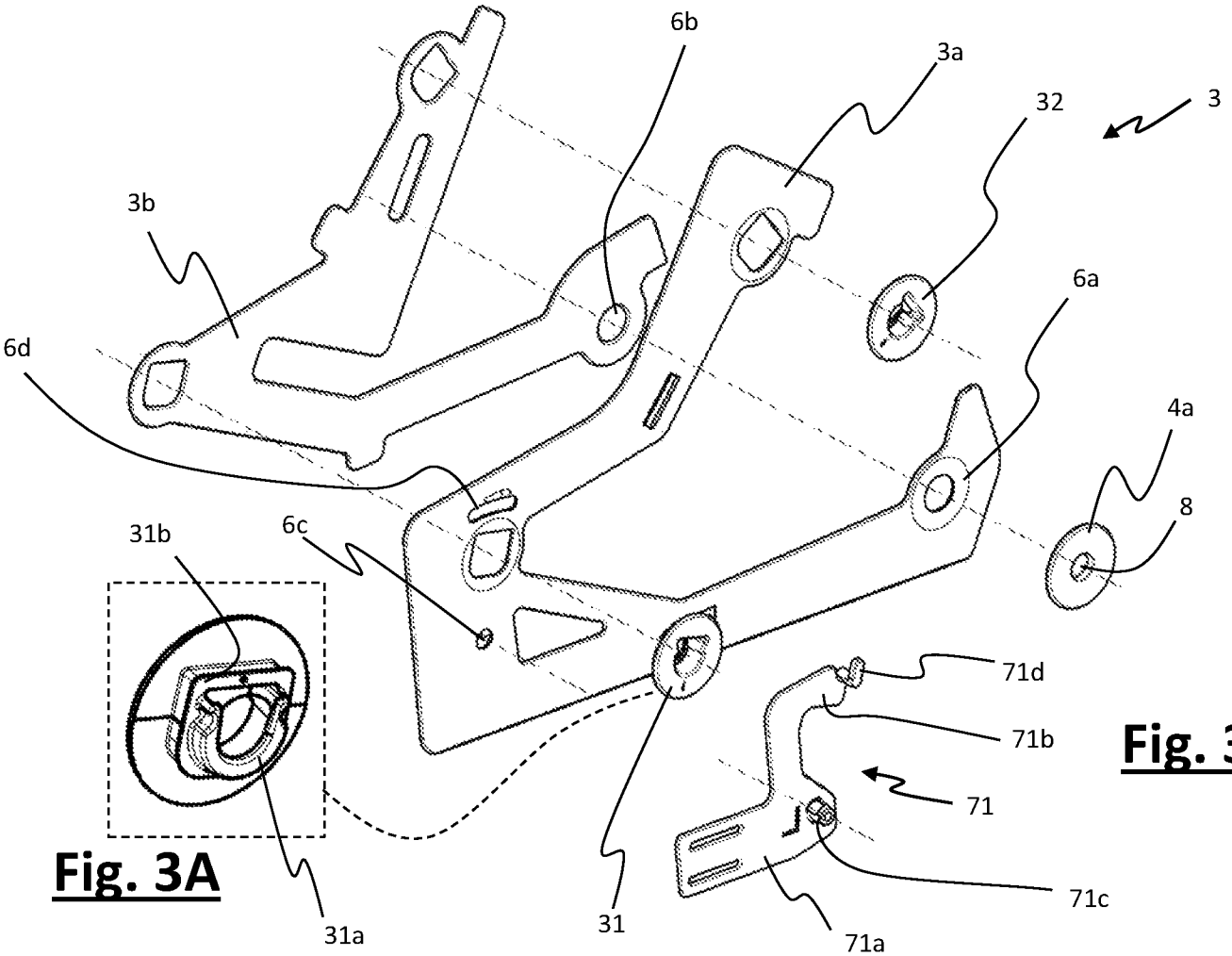
FIG. 3 is a detail of FIG. 2, wherein the frame of the padding element and restraining means are shown; the lever of the restraining means is in the foreground for visualization convenience.
FIG. 3A is a magnified and perspective view of the first seat of the padding element, in a turned around position with respect to what shown in FIG. 3.
Figure 4:
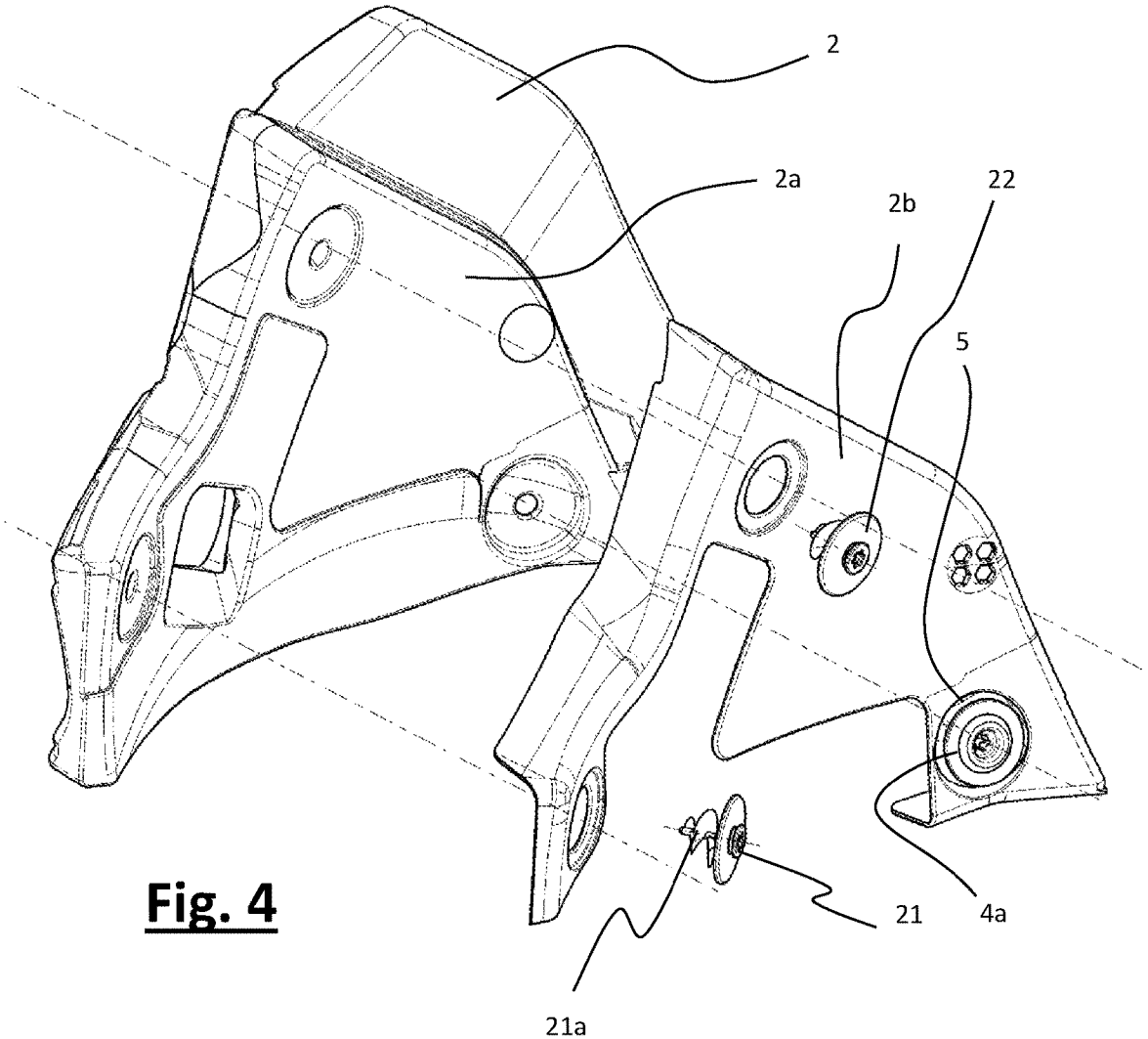
FIG. 4 is a detail of FIG. 2, wherein the portion of the helmet shell to which the padding element has to be constrained is shown.

As mentioned, the padding element 3 has a first seat 31 configured to reversibly accommodate the first protrusion 21. In other terms, the engagement between the first seat 31 and the first protrusion 21 is such to allow at least one degree of freedom for the first protrusion 21, in order to permit the same to be disengaged from the first seat 31. Preferably, the seat 31 comprises an edge 31*a*, visible in particular in FIG. 3A, and adapted to engage the first protrusion 21; such an edge 31*a* defines, in section, an open figure, so that the disengagement of the first protrusion 21 from the seat 31 is allowed. Different typologies of open figures can be used, but typically the edge has a "U" or "C" shape.

More in detail, the edge 31*a* protrudes from a surface 31*b*, which is preferably flat. The helmet 2 is configured so that, when the padding element 3 is engaged to the shell 2, there is no interference between the surface 31*b* and the first protrusion 21, whereas there is interference between the edge 31*a* and the protrusion 21. When the first protrusion 21 is pushed towards the edge 31*a*, the two elements contact each other, and the relative movement between the shell 2 and the padding element 3 is prevented. On the contrary, when the first protrusion is pushed against the missing portion of the edge 31*a*, the protrusion 21 does not meet obstacles and, therefore, can be disengaged from the seat 31 with a consequent relative movement between the padding element 3 and the shell 2.

According to an aspect of the present invention, the first seat 31 and the first protrusion 21 are configured so that an interference coupling can be made. Typically, the first protrusion 21 elastically deforms the seat 31 when introduced in the latter. Referring to the shown portion, the edge 31*a* is U-shaped and has at least one portion with width smaller than the first protrusion 21, so that the protrusion 21 elastically deforms the edge 31 when the former one enters the latter. Preferably, this prevents the padding element 3 from being disengaged from the shell in the usual operations of fitting-taking off the helmet. Such interference is usually mild, to prevent the removal operations of the padding element to become excessively complex, for example to carry out the conventional cleaning and washing activities of the soft padding 3*b*.

In the present description we referred to a "first" seat 31 and a "first" protrusion 21. This does not involve necessarily the presence of further seats and protrusions, even if at least a second seat 32 on the padding element 3, adapted to house a second protrusion 22 in the shell 2, is preferably provided. The second seat 32 and the second protrusion 22 are preferably shaped as the first seat 31 and the first protrusion 21, respectively. Therefore, the second seat 32 is configured to reversibly house the second protrusion 22. The seats 31, 32 and the respective protrusions 21, 22 are placed on the shell 1 so that the shell 2 can be disengaged from the padding element 3 by means of a relative rotation between the two elements around the hinge point 8 defined by the afore said reversible coupling means 4*a*, 4*b*.

The shell 1 further comprises restraining means 7 to restrain the first protrusion 21 in the first seat 31. Such restraining means 7 are designed so as to be movable between a first restraint position of the first protrusion 21 in the first seat 31 and a second disengagement position from the first seat 31. In the first restraint position (shown for example in FIGS. 7 and 10), the restraining means 7 restrain the first protrusion 21 in the first seat 31 when the first one is inserted in the second. Analogously, if the restraining means are in the restraint position and the first protrusion 21 is outside the first seat 31, the entry of the first one into the second is not allowed. On the contrary, when the restraining means 7 are in the second disengagement position (shown for example in FIGS. 8, 9 and 11), the first protrusion 21 is free to be disengaged from, and to be engaged with, the first seat 31.

In the embodiment shown, the restraining means 7 comprise a lever 71. The lever 71 is hinged to the padding element 3, or better to the respective frame 3*a*, 3*b*, and comprises an actuation portion 71*a* and an engaging portion 71*b*. The actuation portion 71*a* is adapted to be directly or indirectly actuated (operated) by a user, to move the restraining means 7 between the mentioned restraint and disengagement positions. The engaging portion 71*b* is adapted to prevent the protrusion 21 from disengaging from the first seat 31, when the restraining means 7 are in the restraint position. Referring to the previously described embodiment, shown in the figures, the engaging portion 71*b* is adapted to cooperate with the edge 31*a*, so that the open shape defined by the edge 31*a* itself is "closed".

The lever 71 is preferably a first-class lever. In other words, the lever 71 is hinged to the padding element 3 so that to rotate around a pin arranged between the actuation portion and the engaging portion 71*b*. The pin may be made in a many ways. In the embodiment shown, the lever is provided with a protrusion 71*c* adapted to be rotatably engaged inside a respective housing 6*c* of the padding element 3. Alternatively, an external pin can be constrained to the lever 71 and be inserted, in use, into the housing 6*c*. Furthermore, in a possible alternative, the lever can be provided with a housing and the padding element 3 with a respective protrusion. Otherwise, connecting means of different types (screws, rivets, etc.) could be used.

Preferably, as in the embodiment shown, a tape 72 can be constrained to the lever, so that a user can easily operate the lever 7. In particular, the tape 72 can be constrained to the lever 71 so that, in use, the tape projects below the shell 2. A string or the like can take the place of the tape 72. Alternatively, there could be no tape 72 and the user could operate directly on the engaging portion 71*b* of the lever 71.

The helmet 1 further comprises limit means 71*d*, 6*d* for the restraining means 7. Typically, such limit means 71*d*, 6*d* comprises a pin 71*d* configured to slide within a respective slot 6*d*. In the embodiment shown, the pin 71*d* is integral with the restraining means 7, whereas the slot 6*d* is made on the padding element 3 (in particular on the frame 3*a*, 3*b* of the padding element 3). The opposite solution can be anyway provided, with a slot made on the restraining means 7 and a pin obtained on the padding element 3. When the restraining means 7 are coupled to the padding element 3, the pin 71*d* is inserted into the slot 6*d*, so that the rotation of the restraining means with respect to the padding element 3 is limited by the run of the pin 71*d* inside the slot 6*d*.

Figure 7:
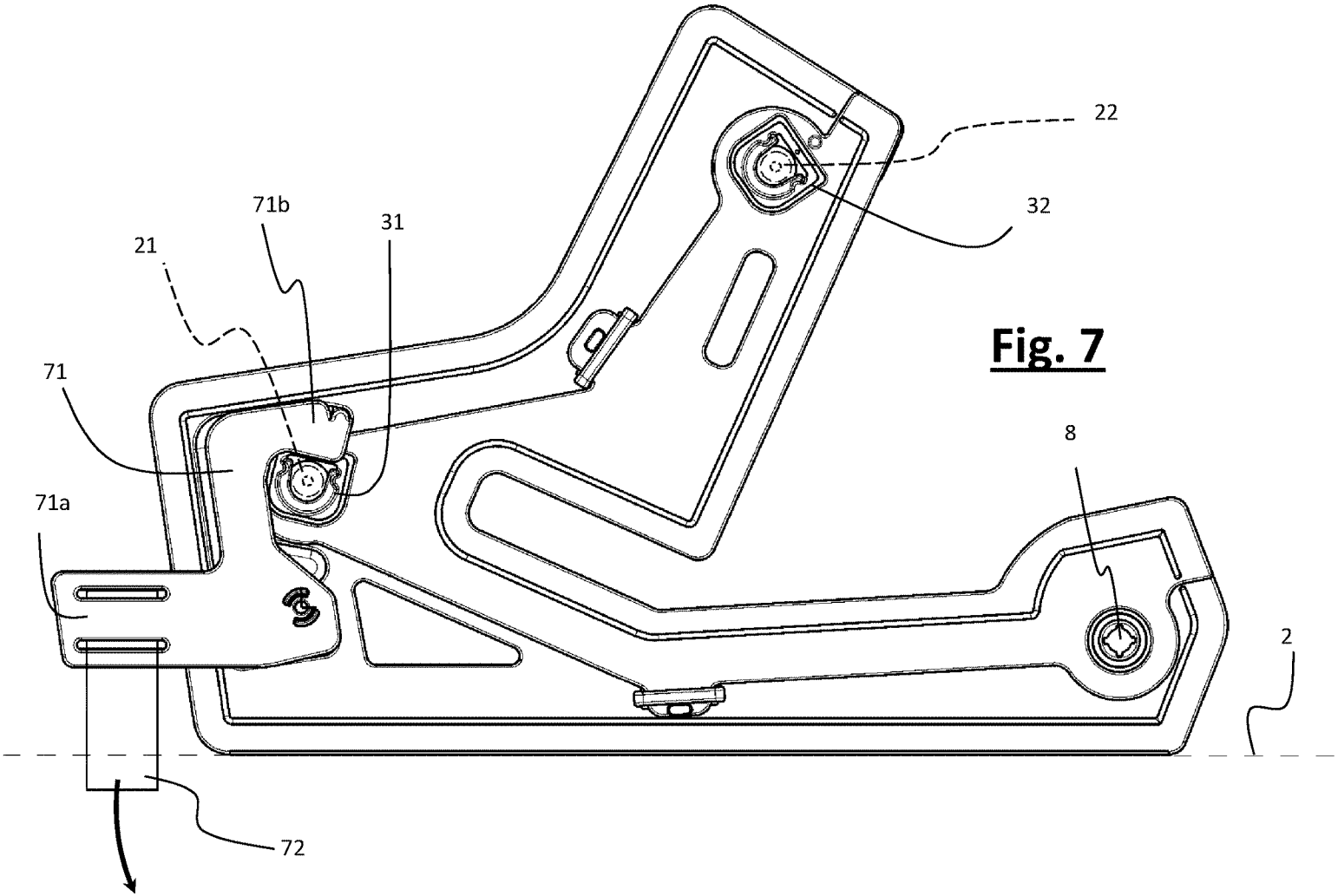
FIG. 7 is a schematic view of the frame of the padding element with the restraining means in the first restraint position; the lower edge of the shell, the first and the second protrusions of the shell being schematically shown with dotted line.
Figure 7A:
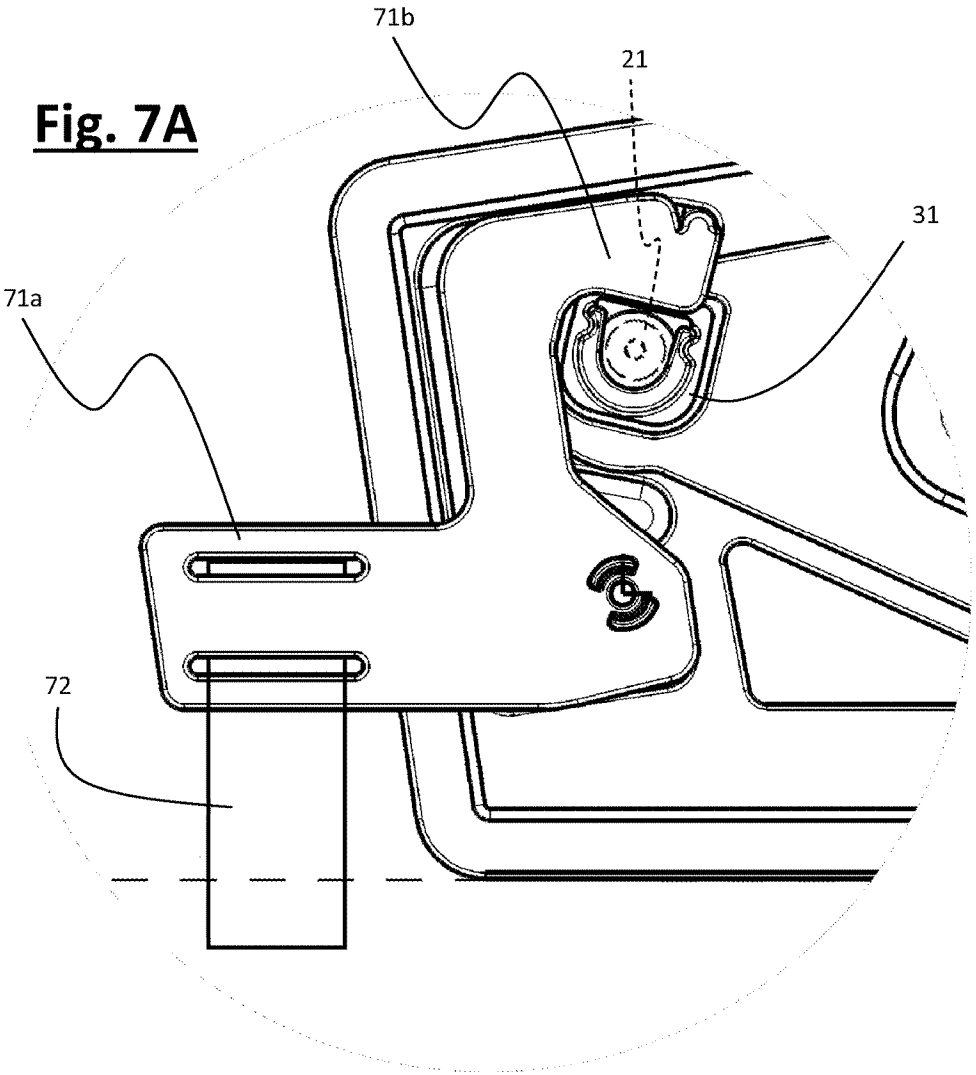
FIG. 7A is a detailed view of FIG. 7, wherein the restraining means and the first seat of the shell are particularly shown.
Figure 10:
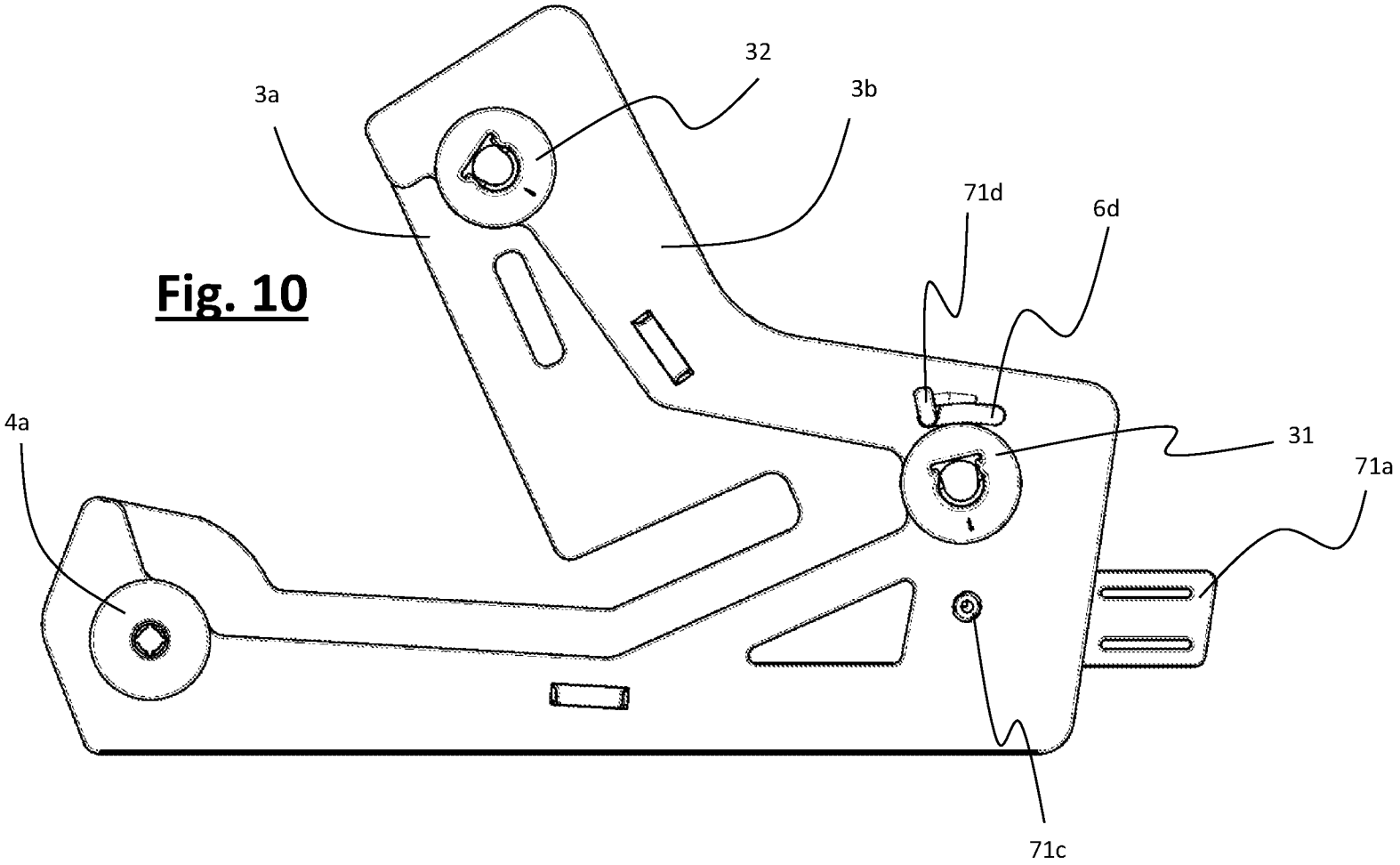
FIG. 10 is a schematic view of the frame of the padding element with the restraining means in the first restraint position, in a turned around position with respect to FIG. 7.

In normal use conditions, the padding element 3 is constrained to the helmet, and the restraining means 7 are in the restraint position of the first protrusion 21 inside the first seat 31, as shown in FIGS. 7 and 10.

Figure 8:
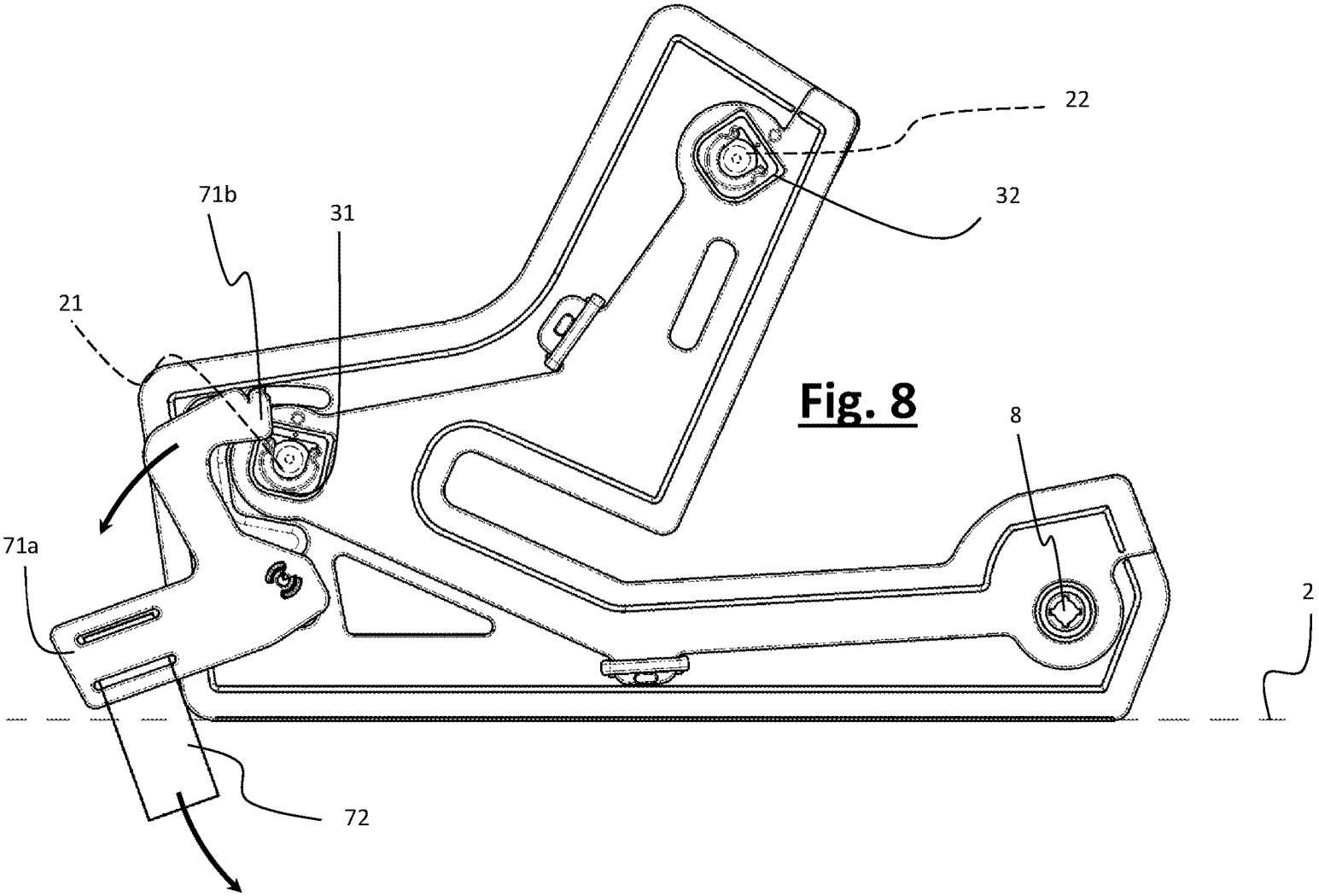
FIG. 8 is a view similar to FIG. 7, but with the restraining means in the second disengagement position, before a relative rotation between the shell and the padding element happens.
Figure 8A:
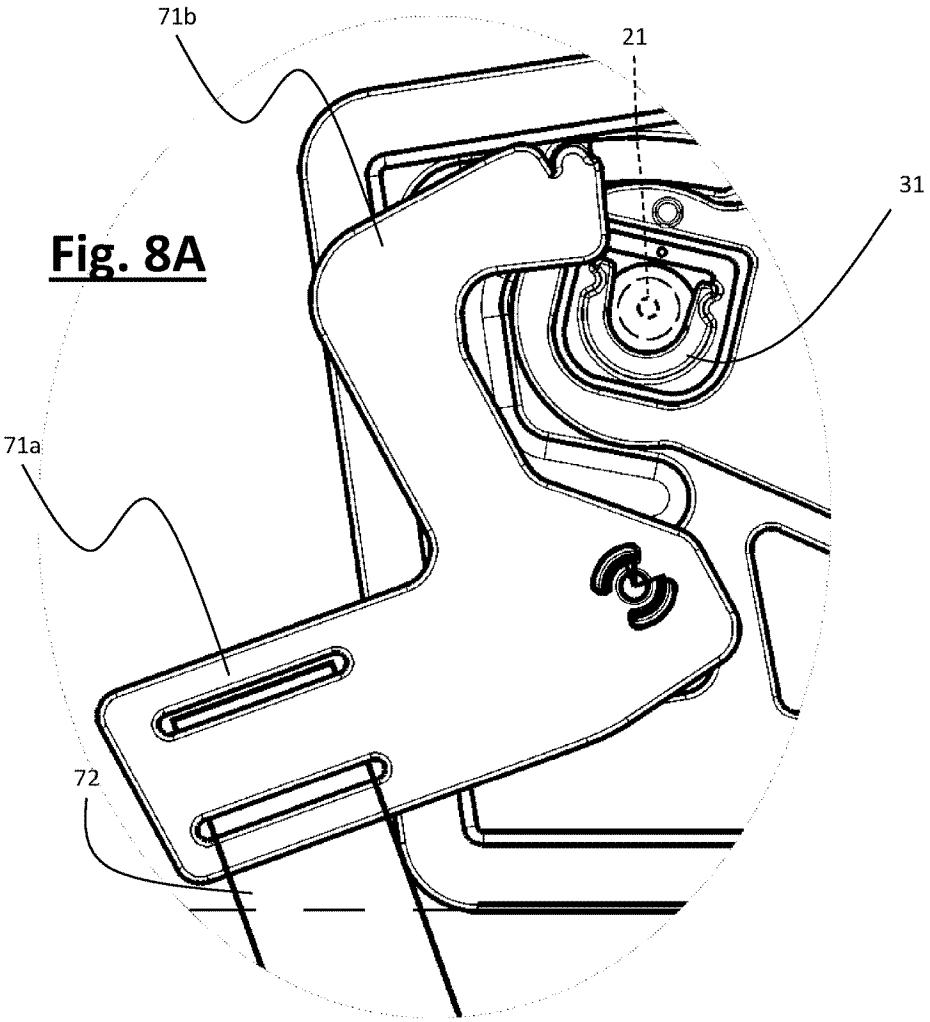
FIG. 8A is a detailed view of FIG. 8, wherein, in particular, the restraining means and the first seat of the shell are shown.
Figure 11:
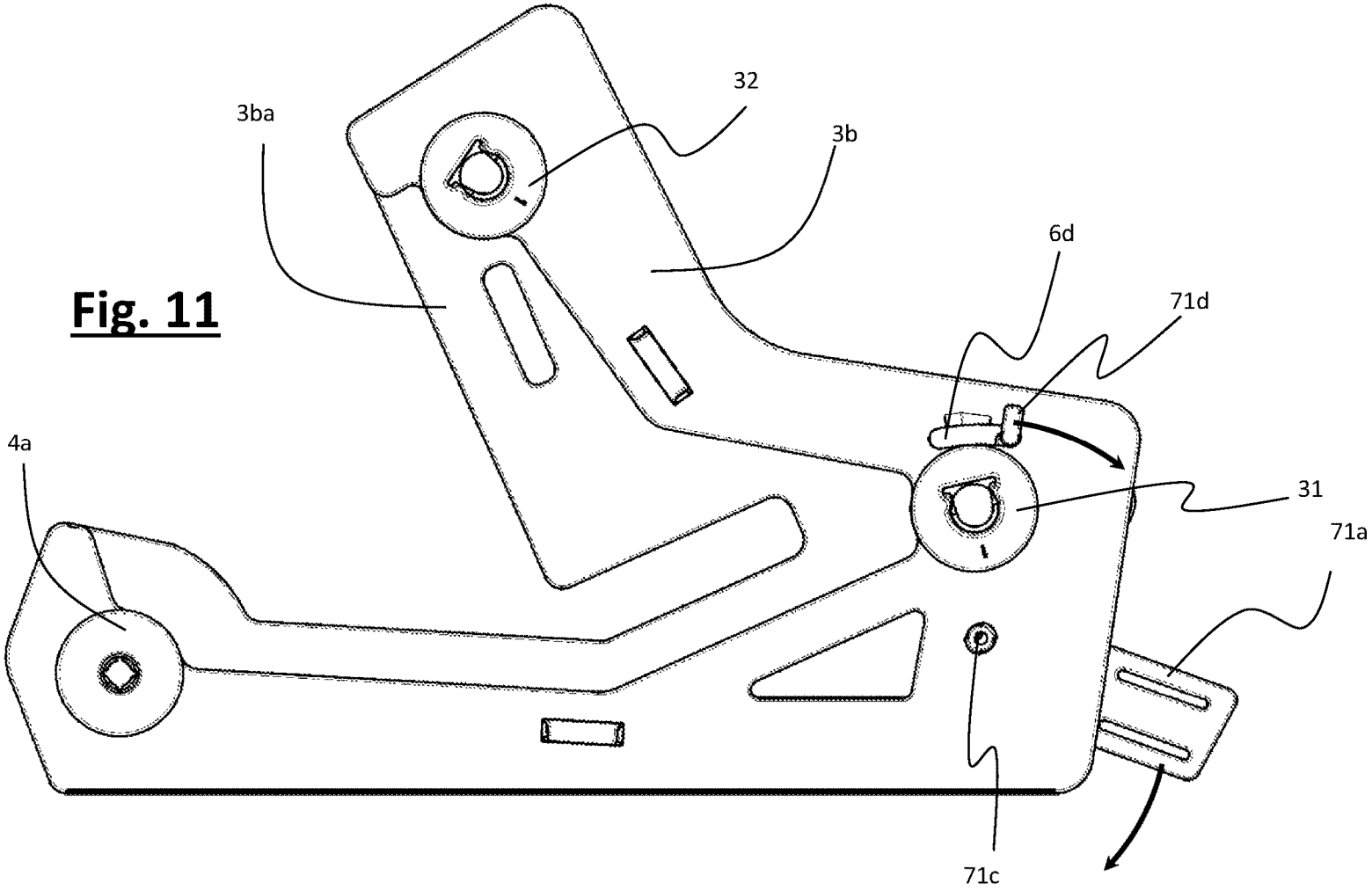
FIG. 11 is a schematic view of the frame of the padding element with the restraining means in the second disengagement position, in a turned around position with respect to FIG. 8.

When the helmet 1 has to be removed easily from the user's head, firstly the restraining means 7 are activated so that they are moved from the restraint position to the disengagement position, as shown in FIGS. 8 and 11. Thanks to this, the first protrusion 21 can be disengaged from the first seat 31. In particular, referring to the embodiment shown, a user actuates (operates) the lever 71 by acting on the actuation portion 71*a* by means of the tape 72. Therefore the engaging portion 71*b* is disengaged from the edge 31*a* of the first seat 31, thus allowing the first protrusion 21 to come out from the seat itself.

Then the user applies a further force onto the padding element 3 to rotate the latter with respect to the shell 2, around the hinge point 8. In a preferred embodiment, the user continues applying a force on the restraining means 7. In other words, according to an embodiment, at the beginning a user applies a force on the restraining means to operate the latter and subsequently to rotate the padding element 3.

In this case, it has to be observed that between the afore said hinge point 8, defined by the reversible coupling means 4*a*, 4*b*, and the force application point being the hinge point of the lever 71 to the padding element 3, the gap is non null, i.e. there is a lever arm allowing an easy rotation of the padding element 3 around such a hinge point 8.

Figure 9:
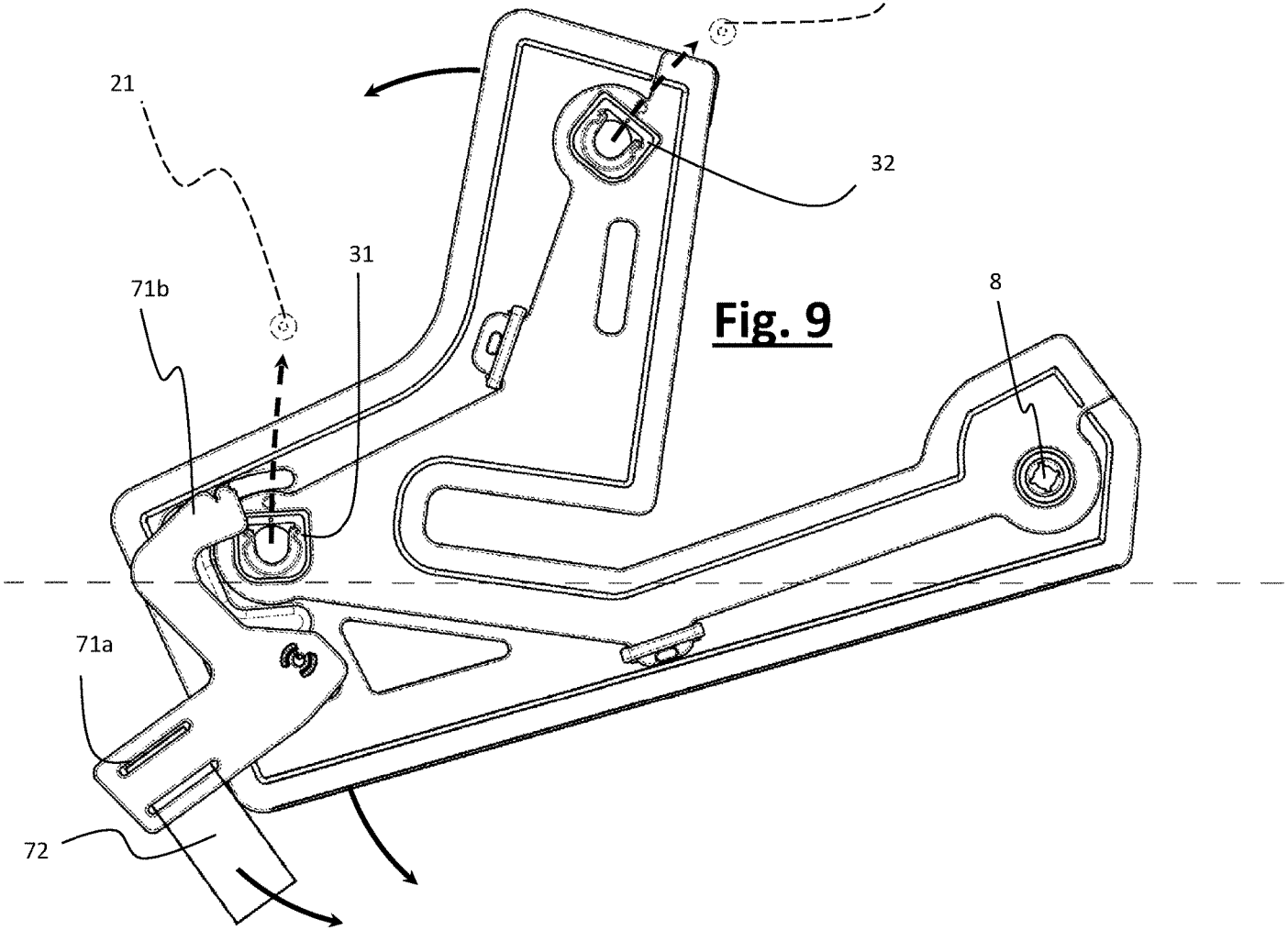
FIG. 9 is a view similar to FIG. 8, but after a relative rotation between the shell and the padding element.
Figure 9A:
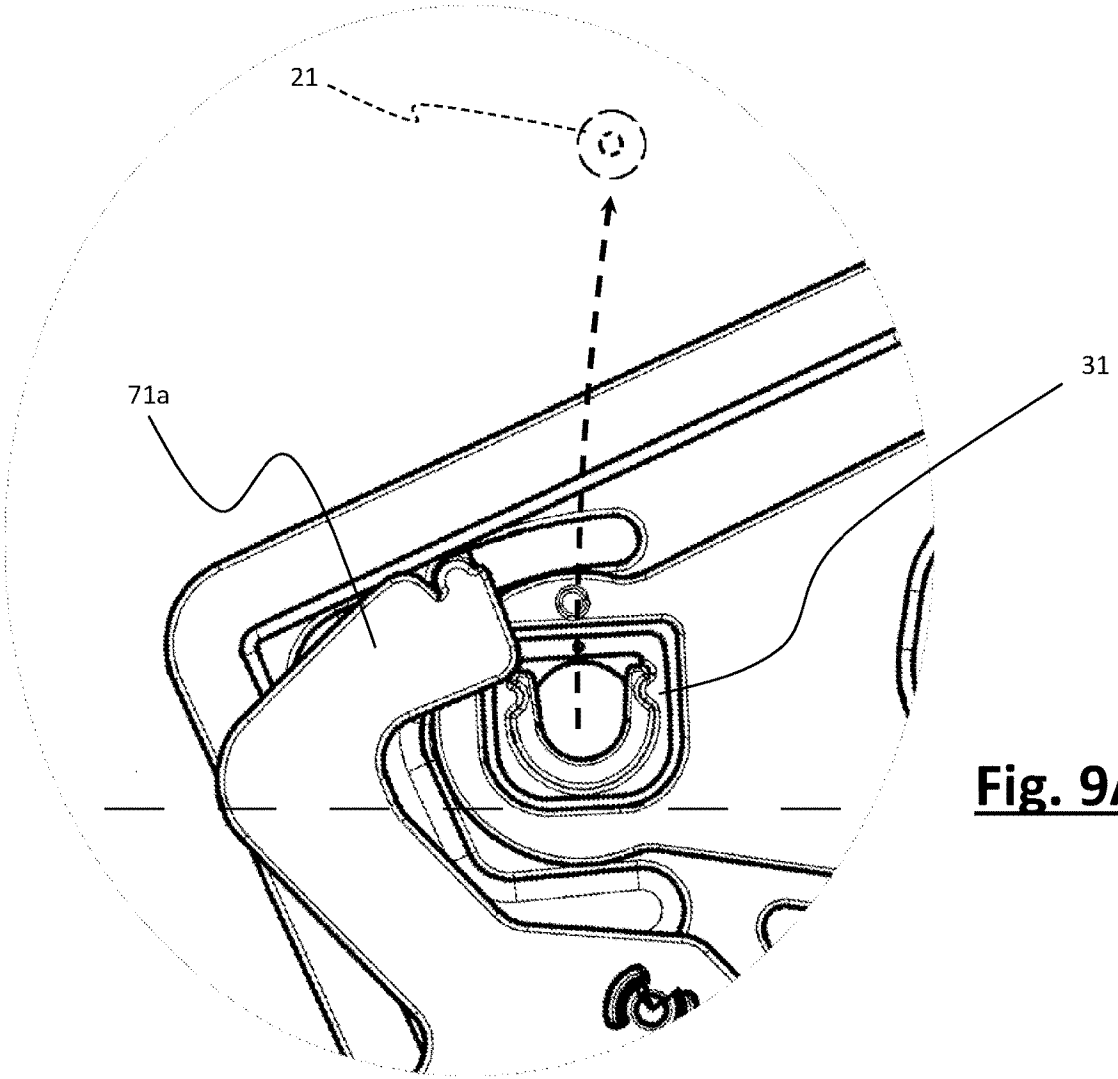
FIG. 9A is a detailed view of FIG. 9, wherein, in particular, the restraining means and the first seat of the shell are shown.

Referring also to FIGS. 9 and 9A, in the embodiment herein shown, firstly a user pulls the tape 72 so that to activate the lever 71, as described above. In particular, the lever 72 rotates around the pin 71*c* by the angle allowed by the run of the pin 71*d* within the slot 6*d*. When the pin 71*d* reaches its own stop, the application of a force onto the lever 71 causes a rotation of the padding element 3 with respect to the shell 2 around the hinge point 8, as shown in the afore mentioned figures.

When the padding element 3 is rotated by a certain angle (typically about 90 degrees), the helmet can be removed from the user's head easily, as the padding element is not an obstacle.

In case the padding element 3 has to be completely removed from the shell 2, following the rotation of the padding element 3 a force can be applied onto the same element 3 along a direction in which the padding element 3 and the shell 2 moves away relatively, in order to cause the detachment of the male element 4*a* from the female element 4*b* of the reversible coupling means 4.

The invention claimed is:

1. A helmet comprising:

a shell for absorbing shocks, a padding element removably constrained to said shell and provided with a first seat so that a respective first protrusion (integral with said shell is reversibly engaged, reversible male-female coupling means to reversibly couple said shell and said padding element, which are adapted to define a hinge point for the relative rotation between said shell and said padding element, wherein said shell comprises the male element and said padding element comprises the female element of said reversible coupling means, or vice versa;

restraining means to selectively restrain and release said first protrusion in and from said first seat;

wherein said restraining means are movable between at least:

a first restraint position, wherein said restraining means engage said first seat to restrain said first protrusion in said first seat, so that the relative rotation between said shell and said padding element around said hinge point is prevented;

a second disengagement position, wherein said restraining means are disengaged from said first seat to release said first protrusion from said first seat, so that the relative rotation between said shell and said padding element around said hinge point is allowed.

2. The helmet according to claim 1, wherein said first seat comprises an edge having an open perimeter, which is optionally U-shaped, and said restraining means are configured so that, in said first restraint position, said perimeter of said edge is closed.

3. The helmet according to claim 1, wherein said reversible male-female coupling means are snap-fit coupling means.

4. The helmet according to claim 1, wherein said restraining means comprise a lever hinged to said padding element, said lever having an actuation portion a user can actuate to move said restraining means between said first restraint position and said second disengagement position, and an engaging portion adapted to engage with said first seat in said first restraint position.

5. The helmet according to claim 1, wherein elastic elements are arranged to push said restraining means towards said first restraint position.

6. The helmet according to claim 1, wherein said shell comprises a foam-made portion, and wherein said first protrusion and the male or female element of the reversibly-coupling means, which is integral with said shell, have a threaded portion for coupling to said foam-made portion.

7. The helmet according to claim 6, wherein said threaded portion has one or more of the following characteristics:

a) thread having variable depth (H), optionally a progressively decreasing one;

b) ratio, between maximum depth (Hmax) and pitch (P) of the thread of said threaded portion, of between 1.00 and 1.80, or between 1.20 and 1.60, or is equal to about 1.40;

c) ratio, between inner diameter (Di) and the maximum depth (Hmax) of the thread of said threaded portion, of between 0.15 and 0.5, or between 0.15 and 0.35, or is equal to about 0.23;

d) thread with variable thread angle (a), with minimum value of between 25 and 35 degrees, or equal to about 30 degrees, and maximum value comprised of 35 and 50 degrees, or to about 43 degrees.

8. The helmet according to claim 1, comprising limit means for said restraining means.

9. The helmet according to claim 8, wherein said limit means comprise a slot and a pin, the latter being adapted to slidingly engage in said slot, said pin being integral with said restraining means and said slot being integral with said padding element, or vice versa.

10. The helmet according to claim 1, wherein said restraining element comprises a second seat to reversibly engage a respective second protrusion integral with said shell.

11. The helmet according to claim 1, wherein said padding element is a side cheek pad.

12. A method for removing a helmet according to claim 1 from a user's head, comprising the steps of:

(a) moving said restraining means from said first restraint position to said second disengagement position, so that said first protrusion can be released from said first seat;

(b) rotating said padding element with respect to said shell around said hinge point; and (c) taking off said helmet from the user's head.

13. The method according to claim 12, wherein said steps (a) and (b) are carried out by applying a force on said restraining means.

* * * * *